US009540753B1

(12) United States Patent
Rivera

(10) Patent No.: US 9,540,753 B1
(45) Date of Patent: Jan. 10, 2017

(54) WASH-ASSISTING BRUSH DEVICE AND METHOD OF USE THEREOF

(71) Applicant: CANDI APPLE TECH, CORP., West Palm Beach, FL (US)

(72) Inventor: John Rivera, West Palm Beach, FL (US)

(73) Assignee: CANDI APPLE TECH, CORP., West Palm Beach, FL (US)

( * ) Notice: Subject to any disclaimer, the term of this patent is extended or adjusted under 35 U.S.C. 154(b) by 0 days.

(21) Appl. No.: 14/955,781

(22) Filed: Dec. 1, 2015

(51) Int. Cl.

| | |
|---|---|
| ***G06F 7/00*** | (2006.01) |
| ***D06F 7/00*** | (2006.01) |
| *D06F 39/02* | (2006.01) |
| *D06F 95/00* | (2006.01) |
| *D06F 35/00* | (2006.01) |

(52) U.S. Cl.
CPC ..... *D06F 7/00* (2013.01); *D06F 35/00* (2013.01); *D06F 39/024* (2013.01); *D06F 95/008* (2013.01)

(58) Field of Classification Search
CPC ..... D06F 7/00; D06F 35/006; D06F 39/024; D06F 95/006; D06F 95/008; D06F 35/00; A46B 13/001
See application file for complete search history.

(56) References Cited

U.S. PATENT DOCUMENTS

| | | | | |
|---|---|---|---|---|
| 2,786,346 | A * | 3/1957 | Brandenburg | D06F 5/005 366/130 |
| 2003/0192353 | A1* | 10/2003 | Li | D06F 35/00 68/235 R |
| 2006/0162397 | A1* | 7/2006 | Ke | D06F 95/008 68/235 R |
| 2013/0220868 | A1* | 8/2013 | Armstrong | B08B 1/001 206/524.5 |
| 2015/0299933 | A1* | 10/2015 | Oh | D06F 39/024 510/513 |

FOREIGN PATENT DOCUMENTS

| | | | | |
|---|---|---|---|---|
| DE | EP 0438771 | A1 * | 7/1991 | D06F 9/00 |

OTHER PUBLICATIONS

Machine English Translation of Description of E P0438771 A1 (Weihrauch, 107-1991).*

* cited by examiner

*Primary Examiner* — Joseph L Perrin
*Assistant Examiner* — Irina Graf
(74) *Attorney, Agent, or Firm* — The Concept Law Group, P.A.; Scott D. Smiley; Erin A. Martin

(57) ABSTRACT

A wash-assisting brush device including a first wash-assisting body having a curved outer surface and a second wash-assisting body having a curved outer surface, the second wash-assisting body coupled to the first wash-assisting body. The first and second wash-assisting bodies together define an internal washing cavity sized and shaped to hold an article of clothing. The wash-assisting brush device also includes a plurality of bristles projecting outwardly from the outer surface of the first and second wash-assisting bodies.

16 Claims, 8 Drawing Sheets

300

300

600

WASH-ASSISTING BRUSH DEVICE AND METHOD OF USE THEREOF

FIELD OF THE INVENTION

The present invention relates generally to cleaning devices, and, more particularly, relates to a washing machine cleaning device having an internal washing cavity.

BACKGROUND OF THE INVENTION

It is well known that washing items, such as clothing, shoes, hats and the like, in a washing machine often proves insufficient to thoroughly clean particularly dirty items, especially shoes, which must be manually scrubbed in order to become clean. As an added problem, shoe laces must be removed from the shoes prior to being placed within the washing machine to prevent the shoe laces from becoming tangled with mechanical components in the washing machine, such as the agitator. As such, shoe laces must then be manually scrubbed in order to become clean.

Devices that may be placed in the washing machine to assist with the washing process are well-known. For example, at least one known device allows a user to place a clothes-washing ball within the washing machine. The clothes-washing ball includes a number of bristles that contact the clothes during washing to brush the clothes. This is not conducive for use with items prone to tangling, e.g., shoe laces, as the shoe laces would quickly become tangled around the clothes-washing ball. Other cleaning devices are made of material having different buoyancy, resulting in the cleaning devices being distributed throughout the washing machine, to aid in cleaning a majority of the fabric. Unfortunately, these devices also cause shoe laces to become tangled around the devices. Other known cleaning devices for use in the washing machine dissolve in water, thereby rendering them useless for scrubbing heavily soiled items.

Known clothing bags used within washing machines often prove difficult to insert and remove clothing. Such clothing bags also fail to include a scrub brush or bristles exposed on the outer surface of the bag to assist with scrubbing clothing items that may be located outside of the clothing bag. In the same vein, such clothing bags do not include inner protrusions that reduce or prevent friction when the clothing bag is exposed to the internal components of the washing machine, e.g., the agitator.

Therefore, a need exists to overcome the problems with the prior art as discussed above.

SUMMARY OF THE INVENTION

The invention provides a wash-assisting brush device and method of use thereof that overcomes the hereinafore-mentioned disadvantages of the heretofore-known devices and methods of this general type and that provides a device for use in a washing machine that scrubs clothing placed in the washing machine using a plurality of bristles and washes clothing placed within an internal washing cavity and isolated from the washing machine's agitator.

With the foregoing and other objects in view, there is provided, in accordance with the invention, a wash-assisting brush device that includes a first wash-assisting body having an outer surface and a second wash-assisting body also having an outer surface, the second wash-assisting body coupled to the first wash-assisting body. The first and second wash-assisting bodies together defining an internal washing cavity sized and shaped to hold an article of clothing. The wash-assisting brush device includes a plurality of bristles projecting outwardly from the outer surface of the first and second wash-assisting bodies.

In accordance with another feature, an embodiment of the present invention includes the first wash-assisting body having a male fastener adapted to couple to a complementary female fastener disposed on the second wash-assisting body.

In accordance with a further feature of the present invention, the wash-assisting brush device having a locked configuration including the first wash-assisting body coupled to the second wash-assisting body.

In accordance with a further feature of the present invention, at least one of the first wash-assisting body and the second wash-assisting body defines at least one aperture in fluid communication with the internal washing cavity.

In accordance with another feature, the present invention also includes the first wash-assisting body and the second wash-assisting body defining a plurality of apertures in fluid communication with the internal washing cavity.

In accordance with yet another feature, an embodiment of the present invention includes at least a portion of the outer surface of the first and second wash-assisting bodies made of a fluid permeable material.

In accordance with a further feature of the present invention, the washing cavity includes an inner surface defining a first inner-surface circumference and a second inner-surface circumference, the second inner-surface circumference larger than the first inner-surface circumference.

In accordance with yet another feature of the present invention, the washing cavity includes an inner surface having a plurality of friction-reducing protrusions extending therefrom.

In accordance with an additional feature, an embodiment of the present invention includes the plurality of bristles removably coupled to the outer surface of the first and second wash-assisting bodies.

In accordance with a further feature of the present invention, the internal washing cavity is elongated.

In accordance with the present invention, another variation of a wash-assisting brush device is disclosed that has a first wash-assisting body including an outer surface defining at least one aperture and a second wash-assisting body having an outer surface defining a second aperture. The second wash-assisting body is configured to couple to the first wash-assisting body. The first and second wash-assisting bodies together define a washing cavity in fluid communication with the at least one aperture and the second aperture. The wash-assisting brush device also includes a plurality of upstanding bristles coupled to the outer surface of the first and second wash-assisting bodies.

In accordance with a further feature of the present invention, the first wash-assisting body includes a male fastener adapted to couple to a complementary female fastener disposed on the second wash-assisting body to form a seal between the first wash-assisting body and the second wash-assisting body.

In accordance with a further feature of the present invention, the first wash-assisting body is hingedly coupled to the second wash-assisting body.

In accordance with yet another feature of the present invention, the first wash-assisting body defines a first half of the washing cavity and the second wash-assisting body defines a second half of the washing cavity.

In accordance with a further feature of the present invention, the first half of the washing cavity defines a first inner-surface circumference and the second half of the washing cavity defines a second inner-surface circumference, the second inner-surface circumference larger than the first inner-surface circumference.

In accordance with another feature of the present invention, the washing cavity includes an inner surface having a plurality of friction-reducing protrusions extending therefrom.

In accordance with another feature of the present invention, the first and second wash-assisting bodies are made of a nylon material.

In accordance with the present invention, a method of washing an article of clothing in a washing machine is also disclosed that includes providing a wash-assisting brush device having a first wash-assisting body includes an outer surface and a second wash-assisting body having an outer surface, the second wash-assisting body coupled to the first wash-assisting body. The first and second wash-assisting bodies together defining an internal washing cavity sized and shaped to hold an article of clothing. The wash-assisting brush device also includes a plurality of bristles projecting outwardly from the outer surface of the first and second wash-assisting bodies. The method includes placing the article of clothing within the internal washing cavity, coupling the first wash-assisting body to the second wash-assisting body, and placing the wash assisting brush device in a washing machine.

In accordance with an additional feature, the method may also include placing at least one article of clothing in the washing machine.

Although the invention is illustrated and described herein as embodied in a wash-assisting brush device and method of use thereof, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the wash-assisting brush device.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
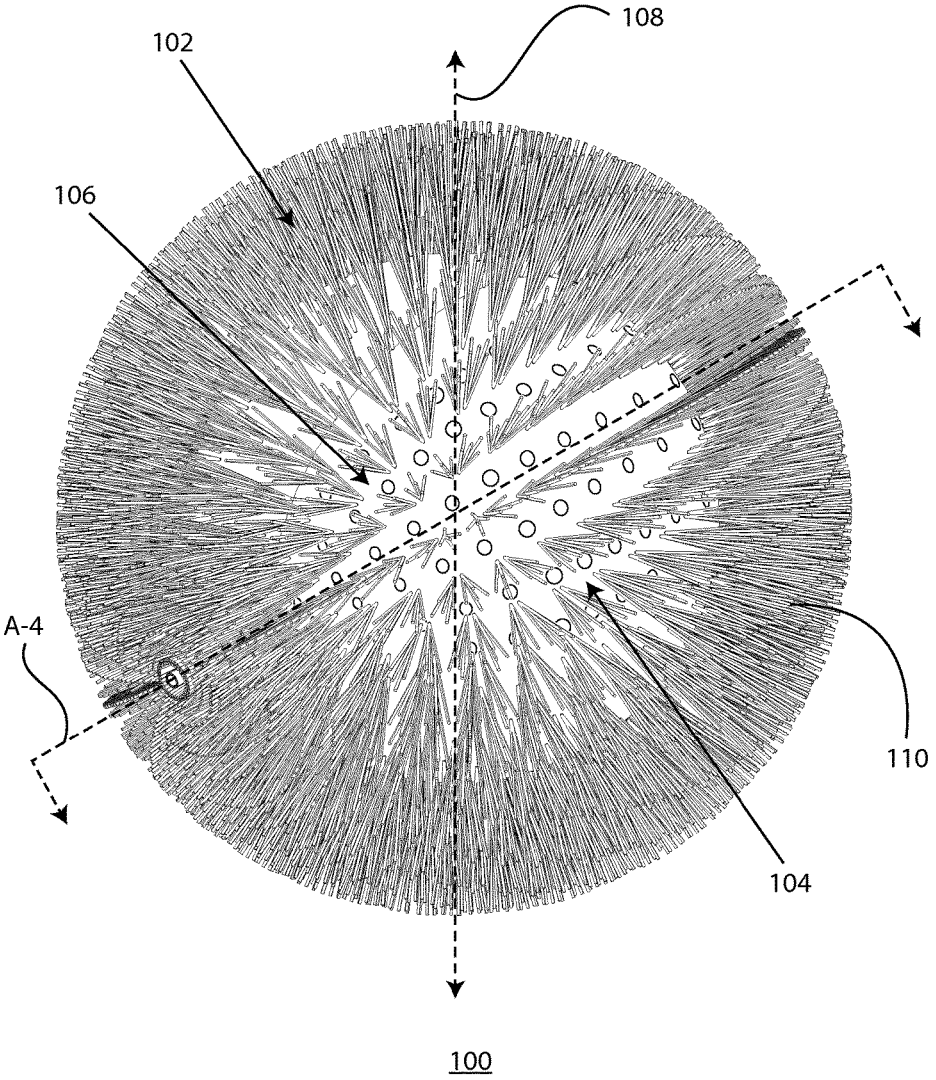
FIG. 1 is a perspective view of a wash-assisting brush device in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient wash-assisting brush device that may be placed in a washing machine with an article of clothing to scrub the article of clothing using a plurality of upstanding bristles extending from an outer surface of the device. The term "clothing" is defined herein in its broadest possible sense and includes, but is not limited to, garments for the body, shoes, hats, towels, gloves and other items commonly washed in a washing machine. The term "shoe" is defined herein in its broadest possible sense and refers to any covering of the foot including, but not limited to, conventional shoes, fabric shoes, sneakers, rubber footwear, slippers, sandals, flip-flops, and any other type of covering for the foot that is suitable for placement in the washing machine. Embodiments of the invention provide the outer surface having a plurality of apertures in fluid communication with an internal washing cavity for simultaneously washing a second article of clothing placed within the washing cavity. As such, the second article of clothing is isolated from the washing machine's agitator or other components of the washing machine that would snag or cause the clothing to become tangled. The wash-assisting brush device may be especially useful for scrubbing shoes, while also washing shoe laces placed within the internal washing cavity.

Referring now to FIG. 1, one embodiment of the present invention is shown in a perspective view. FIG. 1 shows several advantageous features of the present invention, but, as will be described below, the invention can be provided in several shapes, sizes, combinations of features and components, and varying numbers and functions of the components. The first example of a wash-assisting brush device 100, as shown in FIG. 1, depicts the wash-assisting brush device 100, i.e., device, including a first wash-assisting body 102 coupled to a second wash-assisting body 104. The first and second wash-assisting bodies 102, 104 include an outer surface 106 and together form a spherical shape. More specifically, in one embodiment, the first wash-assisting body 102 and the second wash-assisting body 104 each form a hemispherical shape. The term "hemispherical" is defined as having a shape approximating half of a sphere. In other embodiments, the first and second wash-assisting bodies 102, 104 may vary in dimensions with respect to one another. Said another way, the first wash-assisting body 102 may be larger or smaller than the second wash-assisting body 104. The term spherical shape includes, but is not limited to, a sphere, prolate spheroid, oblate spheroid, and the like. In other embodiments, the device 100 may be rectangular, square, triangular or another shape. In one embodiment, the device 100 includes a length 108, i.e., diameter, between 5-7 inches. In other embodiments, the length 108 may be outside of this range.

FIG. 1 depicts a plurality of bristles 110 projecting outwardly from the outer surface 106 of the first and second wash-assisting bodies 102, 104. Advantageously, in use, such as when the device 100 is placed within a washing machine with clothing, the bristles 110 scrub the clothing during a washing cycle, thereby eliminating the need for a user to manually scrub the clothing. As such, the device 100 is especially beneficial for use with clothing that necessitates additional washing treatment beyond that provided by a washing machine alone, due to dirt, soil, and other hard to remove stains.

In one embodiment, the bristles 110 substantially surround the device 100. The term "substantially surround" is defined herein as covering at least 70%-80% of a total surface area of the outer surface 106 of the device 100. In other embodiments, the bristles 110 may cover less than this range or may completely surround the outer surface 106 of the device. The bristles 110 may be made of, without limitation, a nylon material, polypropylene, polyester, polystyrene, or another type of material suitable for use in a washing machine that is preferably stain and odor resistant. In one embodiment, the bristles 110 are removably coupled to the outer surface 106 of the first and second wash-assisting bodies 102, 104. In such advantageous embodiments, the bristles 110 may be easily and inexpensively replaced. In other embodiments, the bristles 110 may be fixedly coupled to the outer surface 106.

Figure 2:
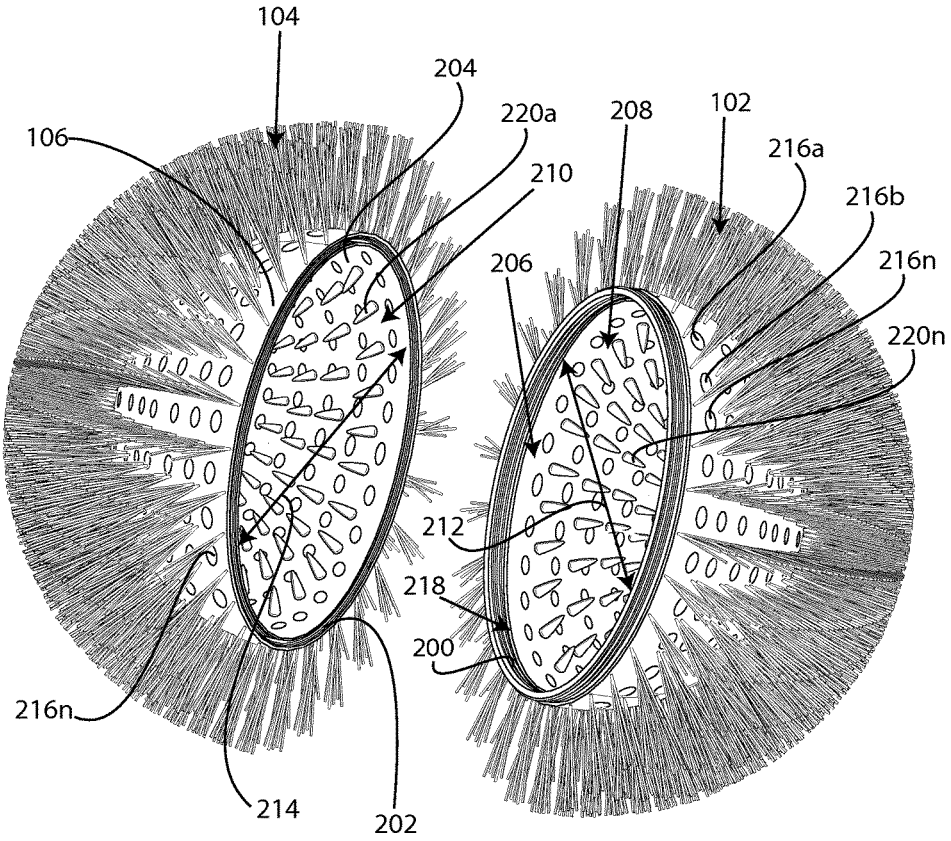
FIG. 2 is a cross sectional view of the wash-assisting brush device of FIG. 1, along section A-A depicting an internal washing cavity.
Figure 7:
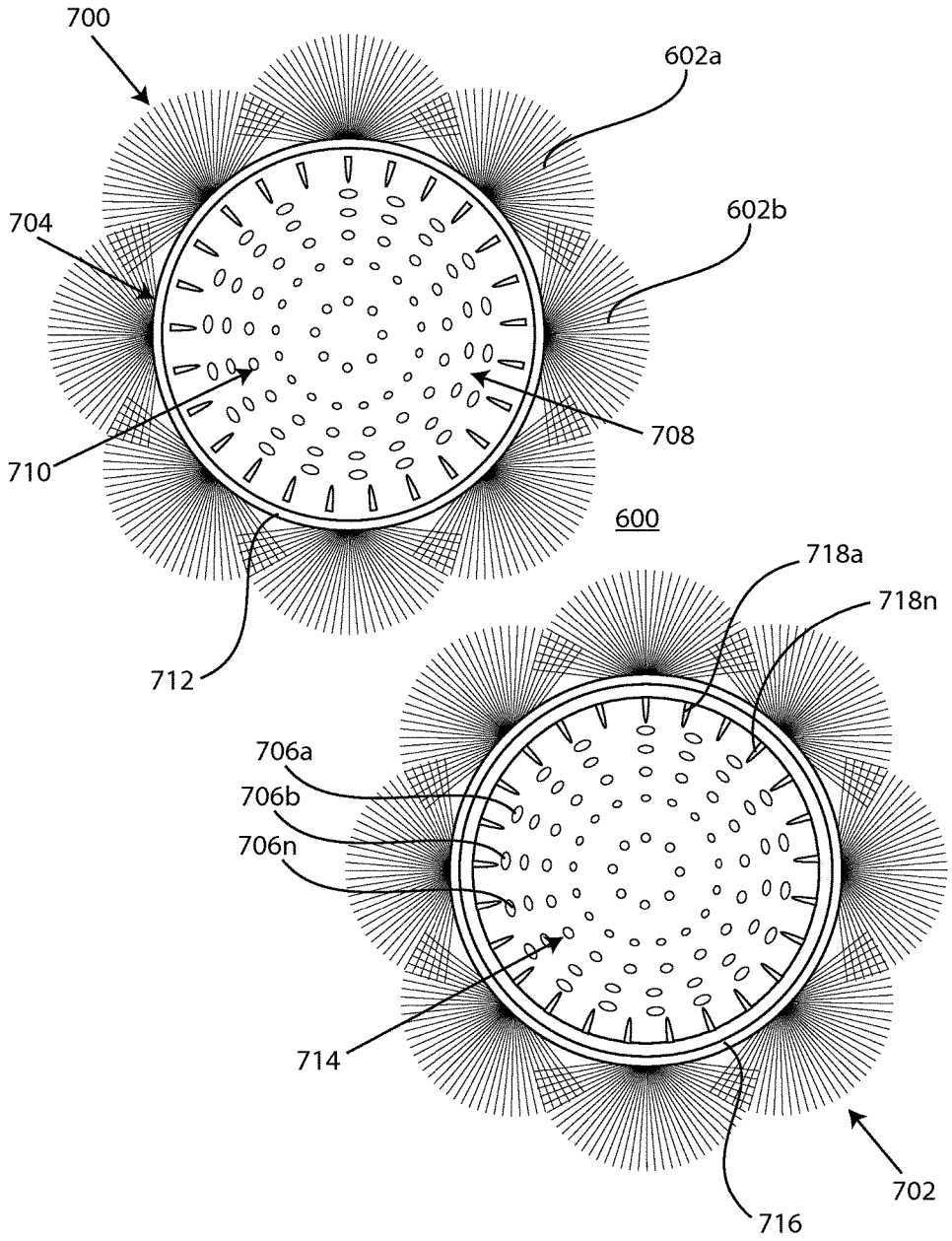
FIG. 7 is a cross sectional view of the wash-assisting brush device of FIG. 6, along section B-B depicting another embodiment of an internal washing cavity.

With reference now to FIG. 2, which depicts a cross sectional view of the device 100 in FIG. 1 along section A-A, in one exemplary embodiment, in order to couple the first and second wash-assisting bodies 102, 104 together, the first wash-assisting body 102 can be seen including a male fastener 200 adapted to couple to a complementary female fastener 202 disposed on the second wash-assisting body 104 to form a screw cap configuration. More specifically, the male fastener 200 is depicted as a cap configured to screw into the female fastener 202 depicted as an outer perimeter of the first wash-assisting body. In other embodiments, the male and female fasteners 200, 202 may be a hook and loop fastener, e.g., Velcro®, clips, a pop lock mechanism, an interlock mechanism, or a fastener having an internal and external thread, e.g., nuts and bolts, snaps, hinges, etc., configured to couple the first and second wash-assisting bodies 102, 104 together. In other embodiments, the first and second wash-assisting bodies 102, 104 may be pressed together in a secure manner so as to prevent the components from uncoupling in the washing machine (FIG. 7).

FIG. 2 depicts the first and second wash-assisting bodies 102, 104 together defining an internal washing cavity 206 sized and shaped to hold the clothing, e.g., shoe laces. In the coupled configuration of FIG. 1, the first and second wash-assisting bodies 102, 104 can be said to be in a locked or sealed configuration to prevent the clothing from becoming dislodged from the washing cavity 206. As such, the clothing is isolated from the washing machine agitator so as to prevent tangling with the agitator. Generally speaking, the agitator is a vertical device disposed in the center of the washing machine bin to assist with pushing the clothing. The agitator alternates directions on a vertical axis, creating friction that a number of washing machines require to loosen dirt from clothing fabric.

FIG. 2 depicts the first wash-assisting body 102 defining the first portion 208 of the washing cavity 206 and the second wash-assisting body 104 defining a second portion 210 of the washing cavity 206. FIG. 2 depicts the first portion 208 having a width 212 of approximately 2-4 inches. In this embodiment, the second portion is depicted having a width 214 of approximately 2-4 inches. The widths 212, 214 and various other dimensions of the first wash-assisting body 102 may vary outside of these ranges depending on the application and design requirements.

In order to allow fluid, e.g., soap and detergent, to enter the washing cavity 206, the outer surface 106 of the device 100 defines at least one aperture 216 in fluid communication with the washing cavity 206. In a preferred embodiment, the first and second wash-assisting bodies 102, 104 define a plurality of apertures 216*a-n* where the indicator "a-n" is intended to represent any number of apertures 216. In other embodiments, at least a portion of the outer surface 106 of the first and second wash-assisting bodies 102, 104 is made of a fluid permeable material. As used herein, the term "fluid permeable material" is defined herein as a material operably configured to allow fluid to pass through.

Figure 3:
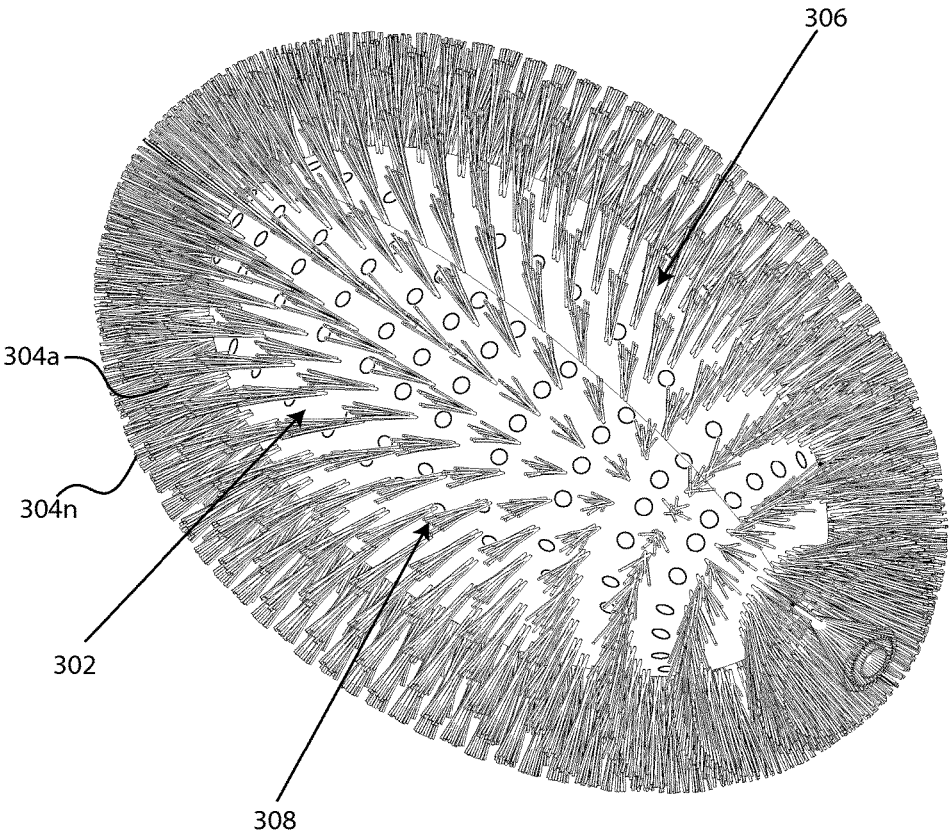
FIG. 3 is a perspective view of an elongated wash-assisting brush device in accordance with another embodiment of the present invention.

In order to reduce the friction caused by the agitator when using the device 100 in the washing machine, the washing cavity 206 includes an inner surface 218 defining a plurality of friction-reducing protrusions 220*a-n* extending therefrom. The friction-reducing protrusions 220*a-n* are disposed adjacent to the apertures 216*a-n* so as to allow fluid to freely enter the washing cavity 206. Said another way, the apertures 216*a-n* are staggered with respect to the friction-reducing protrusions 220*a-n* so as not to obstruct a fluid-flow path from the outer surface 106 through the aperture 216 into the washing cavity 206. In one embodiment, the friction-reducing protrusions 220*a-n* are made of a flexible rubber material that is non-abrasive so as not to cause damage to the article of clothing in the washing cavity 206. In other embodiments, the friction-reducing protrusions 220*a-n* may be made of soft plastic, rubber, silicone, or an alternative material suitable for sustaining placement within the washing machine With reference now to FIGS. 3 and 4, another embodiment of the wash-assisting brush device 300 is depicted in a perspective view and an elevational side view, respectively. The device 300 includes an outer surface 302 having a plurality of bristles 304*a-n* coupled to the outer surface 302. The outer surface 302 and the plurality of bristles 304*a-n* include the same or similar characteristics as the outer surface 106 and the plurality of bristles 216*a-n* described above with regard to the device 100.

Figure 4:
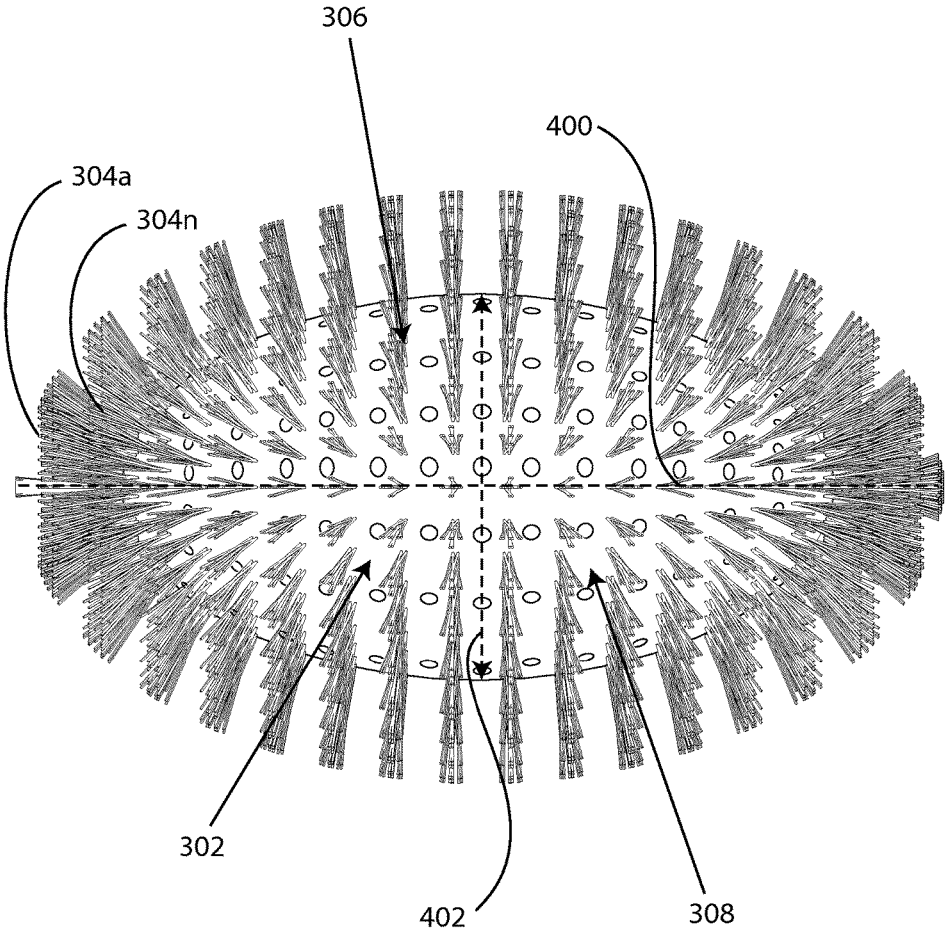
FIG. 4 is an elevational side view of the wash-assisting brush device of FIG. 3.

In contrast to the shape of the device 100 depicted as a sphere, the device 300 includes a first wash-assisting body 306 coupled to a second wash-assisting body 308 to form a prolate spheroid shape that is "elongated." The term elongated is defined herein as having a length 400 greater than a width 402 (FIG. 4). Advantageously, in use, the prolate spheroid shape allows the device 300 to contact a greater amount of the surface area of the article of clothing located in the washing machine than that which would be covered by the device 100. In one embodiment, the length 400 is approximately 8-10 inches and the width 402 is approximately 4-6 inches. The length 400, the width 402, and various other dimensions of the device 300 may vary outside of these ranges depending on the application and design requirements. The device 300 may also form another spherical shape, as similarly described above with regard to the device 100.

With reference to 5, the prolate spheroid shape of the device 300 defines a washing cavity 500 that is elongated and thus advantageous for washing longer or larger articles of clothing when compared to the washing cavity 206 of the device 100. For example, the washing cavity 500 may be beneficial for washing gloves, women's swimwear having attached strings, women's undergarments, and the like, with the cavity 206 being better suited for washing shorter or smaller items, e.g., shoe laces. In order to allow fluid to enter the washing cavity 500, the outer surface 302 of the device 300 defines at least one aperture 502 in fluid communication with the washing cavity 500. In a preferred embodiment, the outer surface 302 defines a plurality of apertures 502*a-n*. In other embodiments, at least a portion of the outer surface 302 of the first and second wash-assisting bodies 306, 308 is made of a fluid permeable material. In other embodiments, in lieu of the device 300 being accessed through an entry point along a horizontal plane, the first and second wash-assisting bodies 306, 308 may be accessed along a vertical plane, similar to the access provided to the device 100.

Similar to the device 100, in order to reduce the friction caused by the agitator when using the device 300 in the washing machine, the washing cavity 500 includes an inner-surface circumference 504 defining a plurality of friction-reducing protrusions 506*a-n* extending from the inner-surface circumference 504. The plurality of friction-reducing protrusions 506*a-n* may have the same characteristics as those described with respect to the protrusions 220*a-n*.

Figure 5:
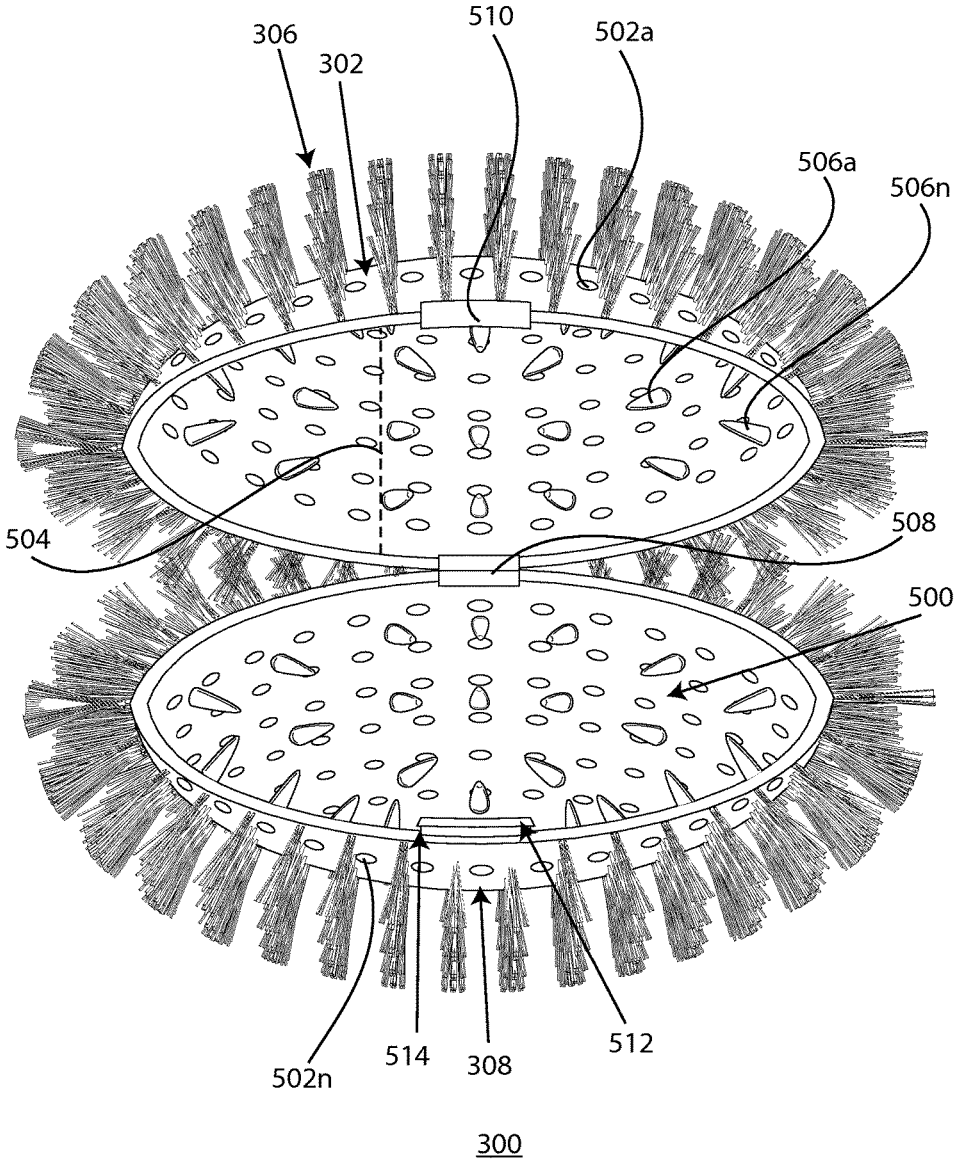
FIG. 5 is an elevational side view of the wash-assisting brush device of FIG. 3 depicting an internal washing cavity in accordance with another embodiment of the present invention.

The first and second wash-assisting bodies 306, 308 can be seen coupled to each other by a coupling member 508, e.g., a hinge, disposed on a rear portion of the device 300. The coupling member 508 allows the first wash-assisting body 306 to move relative to movement of the second wash-assisting body 308, in order to effectively transition the device 300 from an open configuration (FIG. 5) to a locked configuration (FIG. 4). In order to achieve the locked configuration, in contrast to the screw thread configuration as depicted above for the device 100, a projecting clip member 510 (e.g, a male fastener) disposed on a front portion of the first wash-assisting body 306 is inserted into an aperture 512 disposed on an edge of a rim 514 (e.g. complimentary female fastener) on the second wash-assisting body 308. Such configuration prevents movement of the first wash-assisting body 306 relative to the second wash-assisting body 308.

To uncouple the first and second wash-assisting bodies 306, 308 from each other, the user presses a center portion of the clip member 510 and pulls upward on the clip member 510 to release the clip member 510 from the aperture 512. The coupling member 508, in conjunction with the clip member 510 and the aperture 512, allows the user to easily and conveniently open and close the device 300 to access the washing cavity 500. In other embodiments, the first and second wash-assisting bodies 306, 308 may be coupled using the male and female fasteners 200, 202 described above with regard to the device 100.

Figure 6:
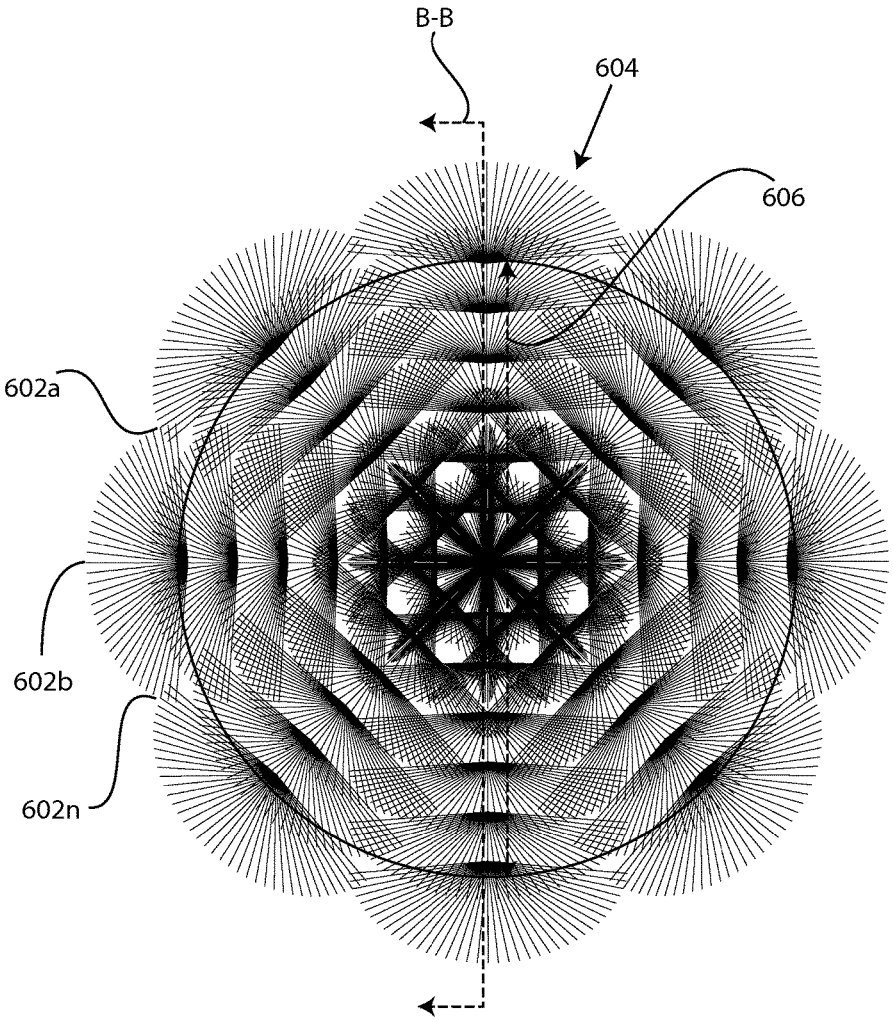
FIG. 6 is an elevational side view of a wash-assisting brush device in accordance with another embodiment of the present invention.

With reference to FIGS. 6 and 7, another embodiment of the wash-assisting brush device 600 is depicted in a perspective view and a cross-sectional view of the wash-assisting brush device of FIG. 6, along section B-B, respectively. As best seen in FIG. 7, the device 600 includes a first wash-assisting body 700 sized and shaped to couple to a second wash-assisting body 702 to form a round shape. The device 600 may also form a spherical shape, as described above with regard to the device 100, 300.

The device 600 includes an outer surface 704 (FIG. 7) having a plurality of bristles 602*a-n* coupled thereto. The bristles 602*a-n* substantially cover the outer surface 704, except for a location of a plurality of apertures 706*a-n* that allow fluid to enter a washing cavity 708. The bristles 602*a-n* vary in length to create a non-uniform bristle edge 604 configured to contact the article of clothing when in use. In one embodiment, the device 600 includes a length 606 of approximately 5-7 inches. The length 606, and various other dimensions of the device 600 may vary outside of these ranges depending on the application and design requirements.

With reference to FIG. 7, the first wash-assisting body 700 is depicted defining a first half 710 of the washing cavity 708 that includes a first inner-surface circumference 712. The second wash-assisting body 702 is depicted defining a second half 714 of the washing cavity 708 that includes a second inner-surface circumference 716 larger than the first inner-surface circumference 712. In order to couple the first wash-assisting body 700 to the second wash-assisting body 702, the user slides the first inner-surface circumference 712 into the second inner-surface circumference 716 and presses the components together to form a sealed configuration. In such embodiments, the first inner-surface circumference 712 and the second inner-surface circumference 716 may be referred to as the male and female fasteners. To uncouple the first and second wash-assisting bodies 700, 702, the user simple applies a force to pull the first wash-assisting body 700 from the second wash-assisting body 702.

Similar to the device 100, 300, in order to reduce the friction caused by the agitator when using the device 600 in the washing machine, the first inner-surface circumference 712 of the washing cavity 708 defines a plurality of friction-reducing protrusions 718*a-n* extending from the first inner-surface circumference 712. The plurality of friction-reducing protrusions 718*a-n* may have the same characteristics or different characteristics as those described with respect to the protrusions 220*a-n*.

FIG. 7 depicts the protrusions 718*a-n* positioned so as not to obstruct the apertures 706*a-n*. In order to allow fluid to flow along a fluid flow path from the outer surface 704 through the apertures 706*a-n* into the washing cavity 708, the first inner-surface circumference 712 may include the apertures 706*a-n* substantially aligned with the apertures 706*a-n* on the second inner-surface circumference 716 at a location where the first inner-surface circumference 712 contacts the second inner-surface circumference 716 in the locked configuration (not shown). In other embodiments, the apertures 706*a-n* may be omitted from this location and the remaining apertures 706*a-n* may allow a sufficient amount of fluid to enter the washing cavity 708.

Figure 8:
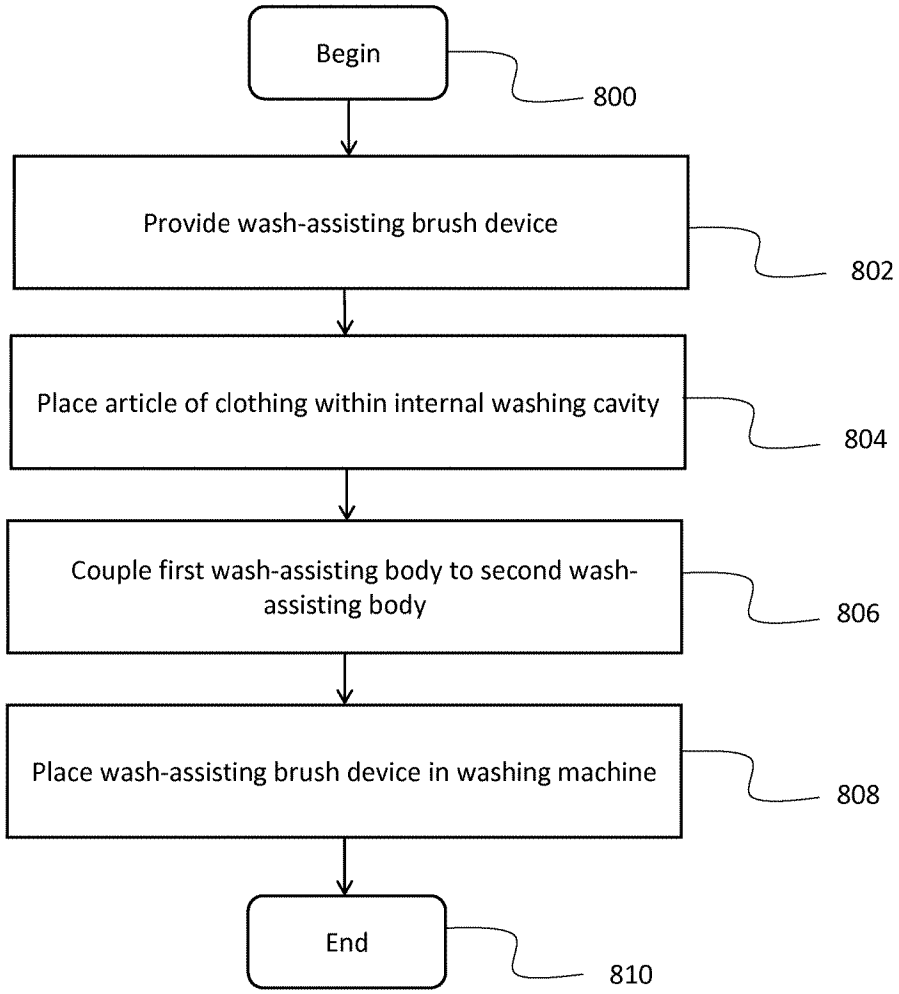
FIG. 8 is a process-flow diagram depicting a method of washing an article of clothing in a washing machine using a wash-assisting brush device.

With reference now to the process flow chart of FIG. 8, in conjunction with FIGS. 1-7, an exemplary method of washing an article of clothing in a washing machine is shown. Although FIG. 8 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 8 for the sake of brevity. In some embodiments, some or all of the process steps included in FIG. 8 can be combined into a single process.

In said process, the method begins as step 800 and immediately proceeds to step 802 of providing a wash-assisting brush device, such as the wash-assisting brush device 100, 300, 600 described above. The wash-assisting brush device includes a first wash-assisting body and a second wash-assisting body that, when coupled to each other, define an internal washing cavity sized and shaped to hold an article of clothing.

In order to couple the first and second wash-assisting bodies together, in one embodiment, the first wash-assisting body includes a male fastener adapted to couple to a complementary female fastener disposed on the second wash-assisting body. The wash-assisting brush device also includes an outer surface and a plurality of bristles projecting outwardly from the outer surface. As described above, the bristles are configured to scrub an item of clothing placed in the washing machine, e.g., shoes. In a preferred embodiment, the outer surface defines a plurality of apertures that allow fluid to enter the washing cavity. In other embodiments, the device may be made from a water permeable material.

The process continues to step 804 of placing the article of clothing, e.g., shoe laces, within the internal washing cavity before the first and second wash-assisting bodies are coupled together. Advantageously, the washing cavity provides the user with an isolated compartment preventing the clothing from contacting the washing machine's agitator or other potentially damaging components. In step 806, the first and second wash-assisting bodies are coupled to each other to form the locked configuration, which may be accomplished using the male and female fasteners or another coupling method, as described above.

In step 808, the wash-assisting brush device is placed within a washing machine. Before or after the wash-assisting brush device is placed within the washing machine, one or more articles of clothing may be placed in the washing machine. In use, the device both scrubs the articles of clothing in the washing machine using the bristles and washes the article of clothing within the washing cavity. The process then terminates at step 810.

A wash-assisting brush device has been disclosed that easily and conveniently washes at least two articles of clothing without the need for manual labor. In use, the device is placed within a washing machine to simultaneously scrub an article of clothing using a plurality of bristles and wash a separate article of clothing placed within an internal washing cavity of the device.

The invention claimed is:

1. A wash-assisting brush device comprising:

a first wash-assisting body having an outer surface;

a second wash-assisting body having an outer surface, the second wash-assisting body coupled to the first wash-assisting body, the first and second wash-assisting bodies together defining:

an internal washing cavity sized and shaped to hold an article of clothing and including an inner surface having a plurality of friction-reducing protrusions extending therefrom; and a plurality of apertures in fluid communication with the internal washing cavity, the plurality of apertures in a staggered relationship with respect to the plurality of friction-reducing protrusions; and a plurality of bristles projecting outwardly from the outer surface of the first and second wash-assisting bodies.

2. The wash-assisting brush device according to claim 1, wherein:

the first wash-assisting body includes a male fastener adapted to couple to a complementary female fastener disposed on the second wash-assisting body.

3. The wash-assisting brush device according to claim 1, further comprising:

a locked configuration including the first wash-assisting body coupled to the second wash-assisting body.

4. The wash-assisting brush device according to claim 1, wherein:

at least a portion of the outer surface of the first and second wash-assisting bodies is made of a fluid permeable material.

5. The wash-assisting brush device according to claim 1, wherein:

the internal washing cavity includes an inner surface defining a first inner-surface circumference and a second inner-surface circumference, the second inner-surface circumference larger than the first inner-surface circumference.

6. The wash-assisting brush device according to claim 1, wherein:

the plurality of bristles are removably coupled to the outer surface of the first and second wash-assisting bodies.

7. The wash-assisting brush device according to claim 1, wherein:

the internal washing cavity is elongated.

8. A wash-assisting brush device comprising:

a first wash-assisting body having an outer surface defining at least one aperture;

a second wash-assisting body having an outer surface defining a second aperture, the second wash-assisting body configured to couple to the first wash-assisting body, the first and second wash-assisting bodies together defining a washing cavity in fluid communication with the at least one aperture and the second aperture, the washing cavity including an inner surface having a plurality of friction-reducing protrusions extending therefrom, the plurality of friction-reducing protrusions in a staggered relationship with respect to the at least one aperture of the first wash-assisting body and the second aperture of the second wash-assisting body; and a plurality of upstanding bristles coupled to the outer surface of the first and second wash-assisting bodies.

9. The wash-assisting brush device according to claim 8, wherein:

the first wash-assisting body includes a male fastener adapted to couple to a complementary female fastener disposed on the second wash-assisting body to form a seal between the first wash-assisting body and the second wash-assisting body.

10. The wash-assisting brush device according to claim 8, wherein:

the first wash-assisting body is hingedly coupled to the second wash-assisting body.

11. The wash-assisting brush device according to claim 8, wherein:

the first wash-assisting body defines a first half of the washing cavity; and the second wash-assisting body defines a second half of the washing cavity.

12. The wash-assisting brush device according to claim 11, wherein:

the first half of the washing cavity defines a first inner-surface circumference; and the second half of the washing cavity defines a second inner-surface circumference, the second inner-surface circumference larger than the first inner-surface circumference.

13. The wash-assisting brush device according to claim 8, wherein:

the first and second wash-assisting bodies are made of a nylon material.

14. A method of washing an article of clothing in a washing machine, the method comprising:

providing a wash-assisting brush device including:

a first wash-assisting body having an outer surface;

a second wash-assisting body having an outer surface, the second wash-assisting body coupled to the first wash-assisting body, the first and second wash-assisting bodies together defining:

an internal washing cavity sized and shaped to hold an article of clothing and including an inner surface having a plurality of friction-reducing protrusions extending therefrom; and a plurality of apertures in fluid communication with the internal washing cavity, the plurality of apertures in a staggered relationship with respect to the plurality of friction-reducing protrusions; and a plurality of bristles projecting outwardly from the outer surface of the first and second wash-assisting bodies;

placing the article of clothing within the internal washing cavity;

coupling the first wash-assisting body to the second wash-assisting body; and placing the wash assisting brush device in a washing machine.

15. The method according to claim 14, further comprising:

placing at least one article of clothing in the washing machine.

16. The method according to claim 14, wherein:

the article of clothing is a shoe lace.

* * * * *